United States Patent [19]

Jahnke et al.

[11] Patent Number: 4,618,539

[45] Date of Patent: Oct. 21, 1986

[54] CORROSION-INHIBITING COMPOSITIONS, AND OIL COMPOSITIONS CONTAINING SAID CORROSION-INHIBITING COMPOSITIONS

[75] Inventors: Richard W. Jahnke, Mentor; William C. Woerner, Pepper Pike, both of Ohio

[73] Assignee: The Lubrizol Corporation, Wickliffe, Ohio

[21] Appl. No.: 678,731

[22] Filed: Dec. 6, 1984

[51] Int. Cl.[4] ..... B32B 15/04; C04B 9/02

[52] U.S. Cl. ..... 428/470; 106/14.42; 252/388; 252/391

[58] Field of Search ..... 252/49.3, 33, 391, 388; 260/97.5, 462 R, 462 C, 404; 106/14.42; 428/470; 427/435, 419.8

[56] References Cited

U.S. PATENT DOCUMENTS

| | | | |
|---|---|---|---|
| 2,441,063 | 5/1948 | Gilmann | 260/404 |
| 3,429,909 | 2/1969 | Schuster | 260/462 R |
| 3,746,643 | 7/1973 | Rogers | 252/33 |
| 3,764,593 | 10/1973 | Schuster | 260/97.5 |
| 4,226,734 | 10/1980 | Schuster | 252/49.3 |
| 4,303,540 | 12/1981 | Schuster | 252/49.3 |

FOREIGN PATENT DOCUMENTS

| | | | |
|---|---|---|---|
| 0120665 | 10/1984 | European Pat. Off. | 252/388 |

*Primary Examiner*—Thomas J. Herbert

*Attorney, Agent, or Firm*—James L. Cordek; Denis a. Polyn; Joseph P. Fischer

[57] ABSTRACT

Corrosion-inhibiting compositions are described which comprise a mixture of (A) at least one oil-soluble neutral or basic alkali metal or alkaline earth metal salt or complex of at least one organic acid, and (B) a nitrogen- and boron-containing composition which is the reaction product of at least one amino alcohol, at least one of a boric acid or boron trioxide, and at least one organic carboxylic acid. Such compositions exhibit improved corrosion-inhibiting properties, especially when included in preservative oil applications. In a preferred embodiment, the composition of the invention contains, in addition to the nitrogen- and boron-containing compositions, a mixture of calcium and barium salts of one or more organic sulfonic acids.

Oil compositions containing the above-described corrosion-inhibiting compositions also are described. The disclosure also describes methods for inhibiting the corrosion of metal surfaces and metal articles which have been coated in accordance with the method of the invention.

29 Claims, No Drawings

CORROSION-INHIBITING COMPOSITIONS, AND OIL COMPOSITIONS CONTAINING SAID CORROSION-INHIBITING COMPOSITIONS

TECHNICAL FIELD OF THE INVENTION

This invention relates to novel corrosion-inhibiting compositions which are useful especially in preservative oil applications. More particularly, the present invention relates to corrosion-inhibiting compositions which comprise mixtures of alkali metal and alkaline earth metal salts and nitrogen- and boron-containing compositions.

BACKGROUND OF THE INVENTION

The problems associated with the handling of metal pieces in the metal-working industry are well known to those skilled in the art. In addition to the rust and corrosion problems, the metal-working industry presently is faced with the problems involved in the various operations such as, for example, rolling, forging, hot-pressing, blanking, bending, stamping, drawing, cutting, punching, spinning, etc. Lubricating oil compositions normally are used to facilitate such metal working operations since they can reduce the power required for the operation, prevent sticking, and decrease wear of dyes, cutting bits and the like, and they frequently also provide rust- or corrosion-inhibiting properties to the metal being treated.

Metal preservative oils are utilized in applications where metals are to be used or stored over extended periods, and it is intended that such oils provide the metal surfaces with extended protection from the environment. In particular, it is desirable that preservative oils applied to metal surfaces are effective corrosion-inhibitors and that the oil-containing compositions are bacteriocidal compositions in order to prevent or retard the growth of micro-organisms resulting in undesirable formation of decaying substances and odors.

Lubricating oil formulations exhibiting non-corrosive, bacteriocidal, and biodegradable characteristics have been described in the prior art, and in particular, in U.S. Pat. Nos. 3,764,593; 4,226,734; and 4,303,540. U.S. Pat. No. 3,764,593 describes boron- and nitrogen-containing condensation reaction products produced by reacting at least two molar proportions of a secondary aliphatic amino alcohol with one molar proportion of a boron-containing component forming an intermediate ester product which is then reacted with a carboxylic acid at an elevated temperature to yield the desired condensation product. Such condensation products are reported to exhibit good wetting and dispersion properties and corrosion-resistance. U.S. Pat. No. 4,226,734 describes a similar composition which is obtained by reacting an excess of diethanol amine with boric acid followed by the addition of lauryl (poly-1-oxapropene) oxaethane carboxylic acid. Such compositions are reported to be cooling, lubricant and cleaning agents for metal work pieces. U.S. Pat. No. 4,303,540 describes cooling, lubricating and cleaning agents comprising the agent formed by the condensation reaction of an excess amino alcohol with boric acid, and the addition of an oxaethane carboxylic acid to the boron-containing complex diamine.

U.S. Pat. No. 3,429,909 describes compositions prepared by reacting a secondary amino alcohol, or a mixture of a secondary and tertiary amino alcohol with boric acid in a mole ratio of about 2:1 at an elevated temperature. The product obtained in this manner is claimed. This patent also discloses the further reaction of the above-prepared condensation products with carboxylic acids with the removal of water.

U.S. Pat. No. 2,441,063 describes compositions prepared by reacting an alkanol amine with a borating agent to form a boric ester of the alkanol amine, and the ester thereafter is converted to a salt by reaction with an acid having at least four carbon atoms. These compositions are reported to be useful as emulsifiers, dispersants and detergents in industrial applications.

SUMMARY OF THE INVENTION

Corrosion-inhibiting compositions are described which comprise a mixture of (A) at least one oil-soluble neutral or basic alkali metal or alkaline earth metal salt or complex of at least one organic acid, and (B) a nitrogen- and boron-containing composition which is the reaction product of at least one amino alcohol, at least one of a boric acid or boron trioxide, and at least one organic carboxylic acid. Such compositions exhibit improved corrosion-inhibiting properties, especially when included in preservative oil applications. In a preferred embodiment, the composition of the invention contains, in addition to the nitrogen- and boron-containing compositions, a mixture of calcium and barium salts of one or more organic sulfonic acids.

Compositions also are described which contain the above-described corrosion-inhibiting compositions. Methods for inhibiting the corrosion of metal surfaces and metal articles which have been coated in accordance with the method of the invention also are described.

DETAILED DESCRIPTION OF THE PREFERRED EMBODIMENTS

Component (A) is at least one substantially neutral or basic alkali metal or alkaline earth metal salt or complex. The alkali metals and alkaline earth metals are, respectively, members of Group IA and Group IIA of the Periodic Table. The preferred alkali metals are lithium, sodium and potassium, and the preferred alkaline earth metals are magnesium, calcium, strontium and barium. A particular preference is expressed for salts and complexes in which the metal is an alkaline earth metal, particularly calcium or barium and still more particularly mixtures thereof.

The non-metallic moiety of the salt or complex is ordinarily derived from an organic acidic compound. Examples of such compounds are phenols, sulfonic acids, carboxylic acids and phosphorus acids.

The word "phenol", as used herein, denotes any hydroxyaromatic compound including hydroxy compounds derived from fused-ring hydrocarbons (e.g., naphthols and the like). Especially preferred in the preparation of component (A) are phenols substituted with aliphatic or cycloaliphatic groups having at least about 6 carbon atoms and up to as many as 7000 carbon atoms. Examples of such groups are hexyl, cyclohexyl, heptyl, decyl, eicosyl, and groups derived from the polymerization of olefins such as ethylene, propylene, 1-butene, 2-butene, isobutene and the like. Groups derived from polymers of propylene and commercial mixtures of butenes (comprising predominantly isobutene) are preferred, especially those having a molecular weight of about 150–1750 (containing about 10–125 aliphatic carbon atoms). The substituent and the aryl nucleus of the phenol may contain other groups such as hydroxy, nitro, nitroso and sulfo groups.

Introduction of the aliphatic or cycloaliphatic substituent onto the phenol can be effected by mixing the hydrocarbon (or a halogenated derivative thereof, or the like) and the phenol at a temperature of about 50°-200° C. in the presence of a suitable catalyst, such as aluminum trichloride, boron trifluoride, zinc chloride or the like. The radical can also be introduced by other alkylation processes known in the art. It is irrelevant which position on the phenolic ring is substituted; any single isomer, or a mixture of isomers, may be used. Polysubstituted materials such as dialkyl and trialkyl phenols may also be present, either alone or in admixture with monoalkyl phenols.

Additional suitable phenols are polyphenols containing sulfur or alkylene bridges, typically prepared by reaction of a simple phenol with sulfur, a sulfur halide such as sulfur monochloride or dichloride, or a lower aliphatic aldehyde (preferably formaldehyde). Polyphenols containing both sulfur and alkylene bridges are also suitable.

The equivalent weight of a phenol for the purpose of this invention is its molecular weight divided by the number of phenolic hydroxy groups therein. Thus, the equivalent weight of phenol is equal to its molecular weight and that of an alkylated resorcinol is half its molecular weight.

The sulfonic acids suitable for use in the preparation of component (A) may be either natural or synthetic sulfonic acids including those represented by the formulae $R^1(SO_3H)_r$ and $(R^2)_xT(SO_3H)_y$. In these formulae, $R^1$ is an aliphatic or aliphatic-substituted cycloaliphatic hydrocarbon-based group free from acetylenic unsaturation and containing up to about 60 carbon atoms. When $R^1$ is aliphatic, it usually contains at least about 15-18 carbon atoms; when it is an aliphatic-substituted cycloaliphatic group, the aliphatic substituents usually contain a total of at least about 12 carbon atoms. Examples of $R^1$ are alkyl, alkenyl and alkoxyalkyl groups, and aliphatic-substituted cycloaliphatic groups wherein the aliphatic substituents are alkyl, alkenyl, alkoxy, alkoxyalkyl, carboxyalkyl and the like. Generally, the cycloaliphatic nucleus is derived from a cycloalkane or a cycloalkene such as cyclopentane, cyclohexane, cyclohexene or cyclopentene. Specific examples of $R^1$ are cetylcyclohexyl, laurylcyclohexyl, cetyloxyethyl, octadecenyl, and groups derived from petroleum, saturated and unsaturated paraffin wax, and polyolefins, including polymerized monoolefins and diolefins containing about 1-8 carbon atoms per olefinic monomer unit. $R^1$ can also contain other substituents such as phenyl cycloalkyl, hydroxy, mercapto, halo, nitro, amino, nitroso, lower alkoxy, lower alkylmercapto, carboxy, carbalkoxy, oxo or thio, or interrupting groups such as —NH—, —O— or —S—, as long as the essentially hydrocarbon character thereof is not destroyed.

As used hereinabove, and elsewhere in the specification and claims, the term "hydrocarbon-based group" denotes a group having a carbon atom directly attached to the remainder of the molecule and having predominantly hydrocarbon character within the context of this invention. Such groups include the following:

(1) Hydrocarbon groups; that is, aliphatic, (e.g., alkyl or alkenyl), alicyclic (e.g., cycloalkyl or cycloalkenyl), aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group).

(2) Substituted hydrocarbon groups; that is, groups containing non-hydrocarbon substituents which, in the context of this invention, do not alter the predominantly hydrocarbon character of the group. Those skilled in the art will be aware of suitable substituents; examples inlcue nitro, hydroxy, RO—, RS—, ROC(O)— and RC(O)— (R being a hydrocarbon group and especially a lower alkyl group.

(3) Hetero groups; that is, groups which, while predominantly hydrocarbon in character within the context of this invention, contain atoms other than carbon present in a chain or ring otherwise composed of carbon atoms. Suitable hetero atoms will be apparent to those skilled in the art and include, for example, nitrogen, oxygen and sulfur.

In general, no more than about three substituents or hetero atoms, and preferably no more than one, will be present for each 10 carbon atoms in the hydrocarbon-based group.

$R^2$ is generally a hydrocarbon-based group free from acetylenic unsaturation and containing about 4-60 aliphatic carbon atoms, preferably an aliphatic hydrocarbon group such as alkyl or alkenyl. It may also, however, contain substituents or interrupting groups such as those enumerated above provided the essentially hydrocarbon character thereof is retained. In general, the non-carbon atoms present in $R^1$ or $R^2$ do not account for more than 10% of the total weight thereof.

The group T is a cyclic nucleus which may be derived from an aromatic hydrocarbon such as benzene, naphthalene, anthracene or biphenyl, or from a heterocyclic compound such as pyridine, indole or isoindole. Ordinarily, T is an aromatic hydrocarbon nucleus, especially a benzene or naphthalene nucleus.

The subscript x is at least 1 and is generally 1-3. The subscripts r and y have an average value of about 1-4 per molecule and are generally also 1.

Illustrative sulfonic acids useful in the preparation of component (A) are mahogany sulfonic acids, petroleum sulfonic acids, mono- and polywax-substituted naphthalene sulfonic acids, cetyl-chlorobenzene sulfonic acids, cetylphenol sulfonic acids, cetylphenol disulfide sulfonic acids, cetoxycapryl benzene sulfonic acids, dicetyl thianthrene sulfonic acids, dilauryl beta-naphthol sulfonic acids, dicapryl nitronaphthalene sulfonic acids, paraffin wax sulfonic acids, unsaturated paraffin wax sulfonic acids, hydroxy-substituted paraffin wax sulfonic acids, tetraisobutylene sulfonic acids, tetra-amylene sulfonic acids, chloro-substituted paraffin wax sulfonic acids, nitroso-substituted paraffin wax sulfonic acids, petroleum naphthene sulfonic acids, cetylcyclopentyl sulfonic acids, lauryl cyclohexyl sulfonic acids, mono- and polywax-substituted cyclohexyl sulfonic acids, postdodecylbenzene sulfonic acids, "dimer alkylate" sulfonic acids, and the like. These sulfonic acids are well known in that art and require no further discussion herein.

For the purpose of this invention, the equivalent weight of a sulfonic acid is the molecular weight thereof divided by the number of sulfonic acid groups present therein. Thus, for a monosulfonic acid the equivalent weight is equal to the molecular weight.

Carboxylic acids suitable for use in the preparation of component (A) include aliphatic, cycloaliphatic and aromatic mono- and polybasic carboxylic acids free from acetylenic unsaturation, including naphthenic acids, alkyl- or alkenyl-substituted cyclohexanoic acids, and alkyl- or alkenyl-substituted aromatic carboxylic acids. The aliphatic acids generally contain at least 8 and preferably at least 12 carbon atoms. The cycloaliphatic and aliphatic carboxylic acids can be saturated or unsaturated. Specific examples include 2-ethylhexanoic acid, linolenic acid, propylene tetramer-substituted maleic acid, behenic acid, isostearic acid, pelargonic acid, capric acid, palmitoleic acid, linoleic acid, lauric acid, oleic acid, ricinoleic acid, undecylic acid, dioctylcylopentanecarboxylic acid, myristic acid, dilauryldecahydronaphthalenecarboxylic acid, stearyloctahydroindenecarboxylic acid, palmitic acid, acids formed by oxidation of petrolatum or of hydrocarbon waxes, and commercially available mixtures of two or more carboxylic acids such as tall oil acids, rosin acids, and the like. The equivalent weight of any such acid is its molecular weight divided by the number of carboxy groups present therein.

The phosphorus acids useful in the preparation of component (A) may contain pentavalent or trivalent phosphorus. The pentavalent phosphorus acids, which are preferred, may be represented by the formula

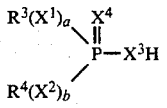

wherein each of $R^3$ and $R^4$ is hydrogen or a hydrocarbon-based group, at least one thereof being hydrocarbon-based; each of $X^1$, $X^2$, $X^3$ and $X^4$ is oxygen or sulfur; and each of a and b is 0 or 1. Thus, it will be appreciated that the phosphorus acid may be an organophosphoric, phosphonic or phosphinic acid, or a thio analog of any of these.

Included among the suitable phosphorus acids are those prepared by the treatment of an olefin polymer (e.g., a polybutene having a molecular weight of about 1000 with a phosphorizing agent such as phosphorus trichloride, phosphorus heptasulfide, phosphorus pentasulfide, phosphorus trichloride and sulfur, white phosphorus and a sulfur halide, or phosphorothioic chloride.

The equivalent weight of a phosphorus acid is its molecular weight divided by the number of hydroxy groups bonded to phosphorus therein.

As previously noted, component (A) may be substantially neutral or basic and may be a salt or a complex. Neutral salts are well known materials containing one equivalent of metal for each equivalent of acidic group, and "substantially neutral" as used herein denotes salts containing about 0.9–1.1 equivalents of metal per equivalent of acidic group.

Basic salts and complexes, frequently referred to as "overbased", "superbasic" or "hyperbasic" materials, are also well known in the art and are disclosed in many U.S. Pat. Nos. of which the following are exemplary: 2,616,904; 3,629,109; 2,695,910; 3,746,643; 3,312,618; 3,764,533; 3,350,308. The above patents are incorporated by reference herein for their disclosures of basic salts and complexes. The salts and complexes useful in the present invention also include those disclosed in the above patents merely as intermediates for conversion into more highly basic salts and complexes.

The basic salts and complexes are characterized by the presence therein of metal substantially in excess of one equivalent for each equivalent of acid. The commonly employed method for their preparation involves heating a solution of the organic acid compound in a substantially inert, normally liquid organic diluent such as mineral oil with a stoichiometric excess of a metal neutralizing agent such as the oxide, hydroxide, carbonate, bicarbonate or sulfide at a temperature above 50° C. and filtering the resulting mass. A "promoter" is often used in the neutralization step to aid the incorporation of a large excess of metal. Examples of compounds useful as promoters include phenolic compounds such as phenol, naphthol, alkylphenols, thiophenols, sulfurized alkylphenols, and condensation products of phenols with formaldehyde; alcohols such as methanol, 2-propanol, octyl alcohol, Cellosolve, Carbitol, ethylene glycol, stearyl alcohol and cyclohexyl alcohol; and amines such as aniline, phenylene diamine, phenothiazine, phenyl-beta-naphthylamine and dodecylamine. It is also frequently preferred to further treat the basic compound prepared as described above with an acidic gas, especially carbon dioxide. This treatment may be intermittent and followed by successive treatments with the metal neutralizing agent, and often enables the incorporation of still larger amounts of basic metal in the complex.

The preferred organic acidic compounds for use in the preparation of component (A) are the above-described sulfonic acids, especially those having an equivalent weight of about 300–500. A particular preference is expressed for alkylaromatic sulfonic acids and more particularly for alkylbenzene sulfonic acids.

The metal content of the salt or complex used as component (A) is conveniently denoted by the "metal ratio", which is defined as the ratio of equivalents of metal in the salt or complex to equivalents of anion of the organic acid therein. Thus, a neutral salt prepared from one equivalent of metal neutralizing agent and one equivalent of organic acid has a metal ratio of 1, while a basic salt containing two equivalent of metal per equivalent of organic acid has a metal ratio of 2. For the purpose of this invention, it is preferred to use as component (A) basic salts and complexes having a metal ratio of about 1.1–6.0, although salts or complexes with higher metal ratios may be used if desired. Particularly preferred are salts or complexes with a metal ratio of about 1.1–3.0, and especially non-carbonated salts within this range; that is, basic salts whose preparation does not involve the use of carbon dioxide or other acidic gases.

The preparation of typical neutral and basic salts or complexes useful as component (A) is illustrated in the following examples. In these examples and elsewhere in the specification and accompanying claims, all parts and percentages are by weight unless otherwise specified.

EXAMPLE 1A (Basic calcium sulfonate)

One-thousand parts of a 60% solution in oil of a sodium petroleum sulfonate is heated to 93°–99° C. and a solution of 71.3 parts of 96% calcium chloride in 84 parts of water are added. The mixture is digested at 93°–99° C. for 15 minutes, after which 25.5 parts of lime are added. Heating is continued at 93°–99° C. for 2 hours after which the mixture is dried by heating to 140° C. and filtered. Finally, the mixture is diluted with 203 parts of oil to produce a 40% solution in oil of the desired basic calcium petroleum sulfonate which contains 2.9% calcium and 10% calcium sulfate ash and has a metal ratio of about 1.4.

EXAMPLE 2A (Basic barium sulfonate)

One-thousand parts of a 60% solution in oil of a sodium petroleum sulfonate is heated to 75°-80° C. and 98.5 parts of 96% barium oxide are added while allowing the temperature of the mixture to rise but not to exceed about 100° C. The mixture is digested at about 87°-102° C. for about 0.5 hour and thereafter flash dried, and diluted with about 60 parts of oil. The product obtained in this manner contains 11.2% barium and 20.01% barium sulfate ash. The metal ratio is 2.6.

EXAMPLE 3A (Neutral calcium sulfonate)

A mineral oil solution containing 50% by weight of a sodium petroleum sulfonate (molecular weight 500) is heated at 90° C. for 2 hours with a 20% stoichiometrically excessive amount of calcium chloride and 10% by weight of water. The mixture is then dehydrated by heating to 150° C. and the inorganic chlorides removed by filtration. The filtrate is an oil solution of a neutral calcium petroleum sulfonate.

EXAMPLE 4A (Basic calcium sulfonate)

A mixture of 520 parts of a mineral oil, 480 parts of a sodium petroleum sulfonate (molecular weight of 480) and 84 parts of water is heated at 100° C. for 4 hours. The mixture is then heated with 88 parts of a 76% aqueous solution of calcium chloride and 72 parts of lime (90% purity) at 100° C. for 2 hours, dehydrated by heating to a water content of less than 0.5%, cooled to 50° C., mixed with 130 parts of methyl alcohol and blown with carbon dioxide at 50° C. until substantially neutral. The mixture is then heated to 150° C. to distill off methyl alcohol and water and the resulting oil solution of the basic calcium sulfonate filtered. The filtrate is found to have a sulfate ash of 16%.

EXAMPLE 5A (Basic calcium sulfonate)

A mixture of 300 grams of mineral oil, 690 grams (0.5 mole) of neutral calcium mahogany sulfonate, 75 grams of water and 29 grams of lime (90% purity) is heated at 100° C. for 2 hours and then to 150° C. during a period of 7 hours. The mixture is blown with carbon dioxide at 150° C. until substantially neutral and filtered. The filtrate is found to have a sulfate ash content of 8.2%.

EXAMPLE 6A (Basic barium phenate)

A mixture of 490 parts of a mineral oil, 110 parts of water, 61 parts of heptylphenol, 340 parts of neutral barium mahogany sulfonate and 227 parts of barium oxide is heated at 100° C. for 0.5 hour and then to 150° C. Carbon dioxide is then bubbled into the mixture until the mixture is substantially neutral. The mixture is filtered and the filtrate found to have a sulfate ash content of 25%.

EXAMPLE 7A (Basic barium phosphate)

To 900 parts of a chlorinated polyisobutene having a chlorine content of 4.3% and a molecular weight of 1000 there is added 150 parts of phosphorus trichloride at 110°-190° C. during a period of 15 hours. The mixture is heated at 200° C. for 2 hours, at 180°-190° C./660 mm. for 1.5 hours, and then blown with nitrogen at 170° C. for 2 hours. The residue is hydrolyzed with steam to form an acidic intermediate. A basic barium salt is prepared by adding 400 parts of the acidic intermediate to a mixture of 495 parts of a mineral oil, 100 parts of heptylphenol, 38 parts of water and 62 parts of barium oxide at 90°-95° C. during 1.5 hours. The mixture is heated at this temperature for 0.5 hours, mixed with 257 parts of barium oxide and carbonated at 130°-140° C. until it is substantially neutral. The resulting mixture is diluted with 280 parts of mineral oil and filtered. The filtrate is found to have a sulfate ash content of 25%.

EXAMPLE 8A (Neutral barium phosphate)

A polypropene having a molecular weight of 2000 is mixed with 10% by weight of phosphorus pentasulfide at 190° C. for 6 hours. The resulting phosphosulfurized polypropene is hydrolyzed by treatment with steam at 160° C. to produce an acidic intermediate which is then converted to the neutral barium salt by treatment with a stoichiometric amount of barium hydroxide.

EXAMPLE 9A (Basic barium sulfonate)

A mixture of 900 grams of a mineral oil solution containing 0.41 mole of barium mahogany sulfonate, 46 grams of barium oxide, 145 grams of water and 64 grams of mineral oil is heated at 93°-99° C. for 2 hours, then heated to 150° C. in 7 hours, and filtered. The filtrate has a sulfate ash content of 15.6%.

EXAMPLE 10A (Neutral calcium sulfonate)

To 6500 grams of a mineral oil solution containing 6.53 moles of sodium mahogany sulfonate there is added at 95° C. 622 grams of calcium chloride dihydrate in 1800 ml. of water. The mixture is heated at 95°-100° C. for 0.5 hour and allowed to settle at room temperature for 2 days. The aqueous layer is removed, and the oil layer is washed with water and then with a water-isopropanol-phosphoric acid mixture. The washed layer is dried and filtered. The filtrate has a sulfate ash content of 6.9%.

EXAMPLE 11A (Basic calcium sulfonate)

(Same as Example 4A except that sodium polydodecylbenzene sulfonate is used in the place of sodium mahogany sulfonate).

EXAMPLE 12A (Calcium phenate)

Water (50 parts) is added to a mixture of mineral diluent oil (2250 parts) and heptylphenol (960 parts or 5 moles) at 27° C. To the reaction mixture at 41° C. there is added 231 parts (7 moles) of 91% pure paraformaldehyde throughout a period of 0.75 hour. Lime (catalyst, 6.6 parts or 0.16 mole) is added to the reaction mixture at 41°–43° C. and the whole is heated to 80° C. over a period of 1.1 hours. More lime (200 parts or 4.8 moles) is added to the reaction mixture at 80°–90° C. throughout a period of 0.75 hour. The reaction mixture is heated to 149° C. over a period of 5 hours, blown with nitrogen and heated at 149°–154° C. for 7.2 hours, mixed with a filter aid, and filtered. The filtered product has a calcium content of 7.6% measured as sulfate ash.

Component (B) of the corrosion-inhibiting compositions of the invention is at least one nitrogen- and boron-containing composition which is the reaction product of at least one amino alcohol, at least one of a boric acid or boron trioxide, and at least one organic carboxylic acid. Preferably, an excess of the amino alcohol is utilized in preparing the reaction product.

Typically, the amino alcohol may be a primary, secondary or tertiary amino alcohol, or mixtures thereof. Such amino alcohols can be represented by the formula $$(R)_3N$$

wherein each R is independently hydrogen, a hydrocarbyl group, or a hydroxy hydrocarbyl group containing up to about 10 carbon atoms with the proviso that at least one R group is a hydroxy hydrocarbyl group. Preferably, each of the hydrocarbyl or hydroxy hydrocarbyl groups will contain no more than 3 or 4 carbon atoms. Specific examples of the amino alcohols useful in the present invention include ethanol amine, propanol amine, diethanol amine, triethanol amine, di(propanol-)amine, tri(propanol)amine, N,N-di(lower alkyl)ethanol amine, N,N-di(lower alkyl)propanol amine, N-methyl, N-hydroxyethyl amine, N-ethyl, N-hydroxyethyl amine, N-butyl, N-hydroxyethyl amine, N-methyl, N,N'-dihydroxyethyl amine wherein the lower alkyl group contains up to about 7 carbon atoms, etc. With regard to the propanol amines, both the 1,2- and 1,3-isomers are useful. Generally, the amino alcohol utilized in the present invention is a secondary or tertiary aliphatic amino alcohol with the secondary aliphatic amino alcohols or mixtures of said alcohols with the tertiary aliphatic amino alcohols being preferred.

The boron compounds which are useful in the preparation of the nitrogen- and boron-containing compositions (component (B)) include boric acid, boron trioxide, ($B_2O_3$), boron halides, such as boron trichlorides, and esters of boric acid. Any of the various forms of boric acid also may be used including metaboric acid ($HBO_2$), ortho boric acid ($H_3BO_3$) and tetraboric acid ($H_2B_4O_7$). The esters of these acids include, for example, the methyl, ethyl and propyl esters with the methyl esters being most readily available and therefore most often used. Boric acid, and especially orthoboric acid, are preferred.

The third reactant utilized in the preparation of the nitrogen- and boron-containing composition is at least one organic carboxylic acid. Generally, a wide variety of carboxylic acids can be utilized in forming components (B). The acids can be saturated or unsaturated and preferably will contain at least 8 carbon atoms. Particularly useful carboxylic are monocarboxylic acids containing from about 8 to about 22 carbon atoms as well as the dimers and trimers of said acids and mixtures thereof. Typical acids include lauric, myristic, palmitic, stearic, oleic, tall oil acids, naphthenic acids, phthalic acid, mellisic, ricinoleic, etc. Generally, the carboxylic acids utilized in the present invention will comprise commercial mixtures of acids containing from about 12 to about 22 carbon atoms, and said mixtures often contain dimers and/or trimers of said acids.

As mentioned above, the nitrogen- and boron-containing composition useful as component (B) in the corrosion-inhibiting compositions of the invention comprise the reaction product of at least one amino alcohol, at least one of a boric acid or boron trioxide, and at least one organic carboxylic acid. The manner in which this reaction product is prepared does not appear to be critical although it is preferable that an excess of the amino alcohol be utilized with respect to the amount of boron compound. In one embodiment, at least two equivalents of the amino alcohol are utilized per equivalent of boric acid in the reaction mixture.

In one method of preparing the nitrogen- and boron-containing reaction products, an amino alcohol (preferably at least two molar proportions) is reacted with one molar proportion of the boron compound at an elevated temperature while removing water formed in the reaction to provide a boric ester of the amino alcohol. This boric ester is reacted with at least one organic carboxylic acid at an elevated temperature while removing water formed in the reaction to yield the desired product.

In another embodiment, the nitrogen- and boron-containing compositions, component (B), are prepared by reacting at least one amino alcohol with at least one organic carboxylic acid to form an intermediate which can then be reacted with at least one of the boron compounds identified above. In another, but less preferred embodiment, the organic carboxylic acid may be present with the amino alcohol and borating agent at the time the boric acid of the amino alcohol is formed, but in this embodiment, the temperature of the reaction should not be sufficient to cause any significant esterification or amidation between the alkanol amine and the acid.

The reaction temperature utilized in the preparation of component (B) of the present invention as well as other conditions of the reaction are not critical, and any temperature within a wide range up to the point of thermal decomposition of the product may be employed. Generally, it will be advantageous to utilize a temperature sufficiently high to insure completion of the reaction within a reasonable period of time. Thus, the temperature employed in most instances will be between about 50° C. and about 200° C., and more often, the temperature will be from about 100° C. to about 150° C.

As mentioned above, the organic carboxylic acid may be mixed with the amino alcohol and the borating agent prior to the formation of the boric ester; or the organic carboxylic acid and the borating agent may be mixed together prior to the addition of the amino alcohol; or the amino alcohol and the organic carboxylic acid may be reacted to form the amine salt of the amino alcohol, and this salt then can be borated to form component (B) utilized in the composition of the invention. Accordingly, in those claims which are appended to the specification which recite that component (B) comprises the reaction product of at least one amino alcohol, at least one of a boric acid or boron trioxide, and at least one organic carboxylic acid, said claims are generic to the various processes and include the alternative processes described above.

The preparation of component (B) advantageously is conducted at atmospheric pressure, but if desired, subatmosheric or super-atmospheric pressures may be used. The use of a vacuum tends to accelerate the reaction and the removal of water as it is formed during the reaction. Although generally not necessary, a solvent or diluent such as water or an organic liquid such as xylene, cyclohexanol, etc. may be present. Esterification catalysts may be present during the formation of the boric ester, but generally the reaction takes place readily without such auxiliary agents.

Water is formed in the reaction between the amino alcohol and boric acid. For each mole of boron compound used, from 1 to 3 moles of water can be formed. Water also is formed in a second step of the reaction when the intermediate is reacted with at least one carboxylic acid, and one mole of water should be formed for each mole of carboxylic acid added to the reaction mixture.

In one preferred embodiment, the nitrogen- and boron-containing composition (B) is prepared by (i) heating a mixture of at least two molar proportions of a secondary or tertiary aliphatic amino alcohol with one molar proportion of at least one of a boric acid or boron trioxide to an elevated temperature while removing the water of reaction to yield an intermediate, and (ii) reacting said intermediate with at least one organic carboxylic acid and removing the water formed in the reaction. The molar ratio of aliphatic amino alcohol to boric acid or boron trioxide preferably is in the range of 3:1 to about 5:1.

The following specific examples illustrate the preparation of the nitrogen- and boron-containing composition (B). Unless otherwise indicated in the following examples, all parts and percentages are by weight, and all temperatures are in degrees centigrade.

EXAMPLE 1-B

A mixture of 149 parts (1 mole) of triethanol amine and 23 parts (0.37 mole) of boric acid is prepared and heated to about 100° C. An aqueous distillate is removed over a one hour period while heating the mixture to 200° C. After about 20 parts of water is removed, 438 parts (1.5 moles) of "Unitol DSR-90", a commercial mixture of tall oil fatty acids available from Union Camp Company are added, and the reaction mixture is heated to 200° C. over 1.5 hours while again removing water. About 22 parts of water are removed. The reaction mixture is cooled, and the residue is the desired product.

EXAMPLE 2-B

A mixture of 17 parts (0.27 mole) of boric acid and 176 parts (1.5 moles) of diethylethanolamine is prepared and heated to a temperature of 110° C. while removing water. Since the distillate contains some unreacted diethylethanolamine, 27 parts of diethylethanolamine are added back to the reaction mixture followed by 438 parts (1.5 moles) of Unitol DSR-90. The temperature of the reaction mixture varies from 128° to 97° C. After all of the carboxylic acid is added, the mixture is cooled and the product is recovered.

EXAMPLE 3-B

Into a reaction flask there is added 204 parts of Unitol LFA (a commercial tall oil fatty acid mixture available from Union Camp), and the fatty acid mixture is heated to 70° C. Ethanolamine (43 parts, 0.7 mole) is added over a 20-minute period, and the reaction is exothermic to a temperature of about 98° C. Heating is continued to raise the mixture to about 180° C. over 1.5 hours with a nitrogen sweep while removing an aqueous distillate. The reaction mixture is maintained at a temperature of 180°–185° C. while removing additional water. After cooling the reaction mixture to 100° C., 10 parts (0.15 mole) of boric acid are added and the mixture is again heated to 180° C. over 1.5 hours with a nitrogen sweep while removing an aqueous distillate. After maintaining this temperature for about 1.5 hours, 75 parts of a mineral oil are added and the mixture is cooled to yield the desired product as an oil solution.

EXAMPLE 4-B

Diethanolamine (1000 parts) is charged to a reactor and heated to about 65°–71° C. whereupon 220 parts of boric acid are added with stirring. The mixture is purged with nitrogen and heated to about 175°–182° C. while removing distillate. The reaction mixture is held at this temperature until the total acid number is 185 minimum, and the mixture is cooled to about 120° C. To 1000 parts of the cooled material, there is added 2710 parts of Unitol DSR-90 (a commercial mixture of tall oil fatty acids from Union Camp Company). The batch is heated to 175°–182° C. and maintained at this temperature until the DAN(LZA-NN-1) reaches 40 max. The batch is cooled to 100° C. and cartridge filtered to drums. The product prepared in this manner contains 1.0% boron and 3.5% nitrogen.

EXAMPLE 5-B

Into a reaction vessel there is added 204 parts (0.7 mole) of Unitol LFA (tall oil fatty acid), and the fatty acid mixture is heated to 95° C. whereupon 74 parts (0.7 mole) of diethanol amine are added dropwise in 15 minutes at about 95°–110° C. The reaction mixture is purged with nitrogen as the reaction temperature is raised to 182° C. over a period of about two hours while removing distillate. The reaction mixture is cooled to 125° C., and 16 parts (0.26 mole) of boric acid are added over a period of 15 minutes. The mixture is heated with stirring to a temperature of about 190° C. for a total of about three hours. The cooled reaction mixture is the desired product containing 1.02% boron.

EXAMPLE 6-B

A mixture of 184 parts (1.75 moles) of diethanol amine and 41 parts (0.65 mole) of boric acid is prepared and heated to about 132° C. The mixture is purged with nitrogen while heating to a temperature of about 190° C. while removing a water distillate.

A commercial mixture of tall oil fatty acids (Unitol DSR-90), 500 parts (1.71 moles) is added over a period of about 15 minutes. The mixture then is heated to a temperature of about 180°–200° C. for about 3–4 hours and cooled. The product obtained in this manner is a dark-amber viscous liquid containing 1.04% boron.

The corrosion-inhibiting compositions of the invention are prepared by merely blending component (A), the neutral or basic alkali metal or alkaline earth metal salts or complexes, with component (B), the nitrogen- and boron-containing compositions. The relative amounts of components (A) and (B) contained in the compositions of the invention may be varied widely. Generally, however, the weight ratio of (A):(B) is from about 5:1 to about 1:5.

Generally, the compositions of this invention will include, in addition to components (A) and (B), at least one normally liquid organic diluent (component (C)). The identity of the normally liquid organic diluent will depend upon the anticipated end use for the corrosion-inhibiting composition. Normally, the organic diluent will comprise one or more substantially inert, non-polar organic liquids.

From the standpoint of availability, cost and performance, liquid hydrocarbons and particularly liquid petroleum fractions represent particularly useful organic diluents in some applications. Examples include benzene, an alkylated benzene, paraffin-based petroleum fractions, petroleum ether, petroleum naphthas, mineral oils, lubricating oils, etc. Typically, the liquid organic diluent will be a natural or synthetic lubricating oil or mixtures thereof, particularly when preservative oil compositions are desired.

Natural oils include animal oils and vegetable oils (e.g., castor oil, lard oil) as well as mineral lubricating oils such as liquid petroleum oils and solvent-treated or acid-treated mineral lubricating oils of the paraffinic, naphthenic or mixed paraffinic-naphthenic types. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)-benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Alkylene oxide polymers and interpolymers and derivatives thereof where the terminal hydroxyl groups have been modified by esterification, etherification, etc., constitute another class of known synthetic lubricating oils that can be used as component (C). These are exemplified by the oils prepared through polymerization of ethylene oxide or propylene oxide, the alkyl and aryl ethers of these polyoxyalkylene polymers (e.g., methylpolyisopropylene glycol ether having an average molecular weight of about 1000, diphenyl ether of polyethyene glycol having a molecular weight of about 500–1000, diethyl ether of polypropylene glycol having a molecular weight of about 1000–1500, etc.) or mono- and polycarboxylic esters thereof, for example, the acetic acid esters, mixed $C_3$–$C_8$ fatty acid esters, or the $C_{13}$Oxo acid diester of tetraethylene glycol.

Another suitable class of synthetic lubricating oils that can be used as component (C) comprises the esters of dicarboxylic acids (e.g., phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoether, propylene glycol, etc.) Specific examples of these esters include dibutyl adipate, di(2-ethylhexyl)sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid and the like.

Esters useful as synthetic oils also include those made from $C_5$ to $C_{12}$ monocarboxylic acids and polyols and polyol ethers such as neopentyl glycol, trimethylol propane, pentaerythritol, dipentaerythritol, tripentaerythritol, etc.

Silicon-based oils such as the polyalkyl-, polyaryl-, polyalkoxy-, or polyaryloxy-siloxane oils and silicate oils comprise another useful class of synthetic lubricants (e.g., tetraethyl silicate, tetraisopropyl silicate, tetra-(2-ethylhexyl)silicate, tetra-(4-methyl-hexyl)silicate, tetra-(p-tert-butylphenyl)silicate, hexyl-(4-methyl-2-pentoxy)disiloxane, poly(methyl)siloxanes, poly(methylphenyl)siloxanes, etc.). Other synthetic lubricating oils include liquid esters of phosphorus-containing acids (e.g., tricresyl phosphate, trioctyl phosphate, diethyl ester of decane phosphonic acid, etc.), polymeric tetrahydrofurans and the like.

Unrefined, refined and rerefined oils, either natural or synthetic (as well as mixtures of two or more of any of these) of the type disclosed hereinabove can be used in the compositions of the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

The relative amounts of components (A), (B) and (C) in the compositions of the present invention may be varied widely to produce compositions having specific properties and viscosities. Concentrates as well as preservative oil formulations can be prepared containing various amounts of the diluent. For example, concentrates of the compositions of the present invention may contain a weight ratio of (A):(B):(C) within a range of from about (10–50):(5–40):(10–85). Preservative oil compositions ready for use generally will comprise from about 0.2 to about 30 weight percent of (A), about 0.1 to about 15 weight percent of (B), and from about 55 to about 99.7 weight percent of (C).

As mentioned previously, in one of the preferred embodiments of the present invention the compositions contain a mixture of calcium and barium sulfonates, and such compositions, when prepared as concentrates will comprise from about 5 to about 25 parts by weight of at least one neutral or basic calcium salt of at least one organic sulfonic acid (A-1), from about 5 to about 25 parts by weight of at least one neutral or basic barium salt of at least one organic sulfonic acid (A-2), from about 5 to about 40 parts by weight of at least one nitrogen- and boron-containing composition (B), and from about 10 to about 85 parts by weight of the inert diluent (C).

The following examples illustrate the compositions of the present invention.

TABLE I

| Example | Component (A) Exam. | Component (A) Pts/Wt. | Component (B) Exam. | Component (B) Pts/Wt. | Mineral Oil Pts/Wt. |
|---|---|---|---|---|---|
| I | 1-A | 10 | 1B | 10 | 0 |
| II | 2-A | 10 | 3B | 10 | 20 |
| III | 1-A | 30 | 4B | 20 | 20 |
| | 2-A | 30 | | | |
| IV | 1-A | 5 | 4B | 10 | 0 |
| | 2-A | 5 | | | |
| V | 1-A | 7.5 | 4B | 5 | 0 |
| | 2-A | 7.5 | | | |
| VI | 1-A | 2.5 | 4B | 15 | 0 |
| | 2-A | 2.5 | | | |
| VII | 1-A | 5 | 4B | 10 | 80 |
| | 2-A | 5 | | | |
| VIII | 1-A | 7.5 | 4B | 5 | 80 |
| | 2-A | 7.5 | | | |
| IX | 1-A | 2.5 | 4B | 15 | 80 |
| | 2-A | 2.5 | | | |

The preservative oil compositions of this invention containing components (A), (B) and (C) are useful particularly for coating surfaces of such metals as iron, steel, galvanized steel, and aluminum. Preferably, the compositions are applied to metals which are subject to corrosion such as ferrous metal. The compositions may be applied by techniques known to those skilled in the art such as by brushing, roller coating or spraying. The thickness of the coating on the metal surface would ordinarily be about 0.5 to about 2.5 mils. As will be readily apparent, the thickness of the coating may be varied according to the conditions. Thus, a heavier coating may be applied when the metal is to be subjected to rough handling, prolonged storage, or unusually corroded environments.

Ordinarily, no preliminary treatment need be given to the metal object prior to coating it with the preservative oil compositions of this invention. It may sometimes be advantageous to clean the metal before applying the composition, but this usually is not necessary. Frequently, metal has been first subjected to working, as by cold rolling, after which the composition of this invention is applied. The compositions of the present invention also may serve as light metal working lubricants so that the coated metal objects may subsequently be drawn without addition of further metal working lubricants.

After the composition of this invention is applied to the metal surface, the coated metal articles may be stacked or otherwise stored or shipped, and the coating remains thereon with relatively little run-off or dripping. The metal objects thus coated also are contemplated as part of the invention.

The effectiveness of the compositions of the present invention as preservative oil compositions, and more particularly, as corrosion-inhibiting preservative oil compositions is demonstrated by the following tests conducted utilizing compositions IV, V and VI as described in Table I at various dilutions in mineral oil. The results obtained with these compositions are compared to the results obtained with control samples. Control Sample No. 1 comprises an oil solution of a mixture of equal parts by weight of the calcium salt of Example 1-A and the barium salt of Example 2-A. Control Sample No. 2 is solution in oil of the product of Example 4B.

One test for determining the efficiency of the compositions of the present invention utilizes a salt fog environment, and the test is identified as MIL-L-3150B. The test panels utilized in this test are sandblasted 3-inch by 2-inch by 1/16-inch steel panels. The panels are hand-dipped into the test oil, and the panels are allowed to drip for one hour after removing from the oil. The coated panels are placed in a salt fog cabinet where they are exposed to a spray of 5% aqueous sodium chloride solution. After 48 hours, the panels are removed from the cabinet, washed in naphtha/methanol, and examined for rust spots.

Three panels are coated with each of the test oils. When rating the panels upon completion of the test, a panel is considered a pass if there are not more than three corrosion dots, none of which exceed 1 mm. in diameter on the test panel. Any corrosion on the outer 0.25-inch of the panel is not a cause for failure. The results of the salt fog exposure test are summarized in the following Table II.

TABLE II

| Composition | Salt Fog Resistance Concentration (% Wt.) | Rating |
|---|---|---|
| Control 1 | 20 | 3X-Fail (15% rust) |
| Control 2 | 20 | 3X-Fail (90% rust) |
| Example IV | 10 | 2X-Fail (15% rust) |
| | | 1X-Pass |
| | 20 | 2X-Pass |
| | | 1X-Fail (5% rust) |
| Example V | 10 | 3X-Pass |
| | 20 | 3X-Pass |
| Example VI | 20 | 3X-Fail (10% rust) |

Another test conducted on panels treated with the compositions of the present invention is a 100% relative humidity test (ASTM D-2247). This method subjects the coated metal specimens to 100% relative humidity with condensation on the test specimens at all times. In this test, steel panels are coated by drawdown with a No. 18 wire-wound rod, allowed to drip for about 15 to 30 minutes and thereafter placed in the humidity chamber. The temperature of the saturated air is maintained at 110° F. (43° C.). The metal panels are examined for percent area corroded as the test progresses, and the results recorded after 192 and 408 hours are summarized in the following Table III.

TABLE III

| Humidity Test Results ASTM-D-2247 | | | |
|---|---|---|---|
| Composition | Concentration (% Wt.) | Percent Rusted Area 192 hrs. | Percent Rusted Area 408 hrs. |
| Control 1 | 3 | 75 | 80 |
| | 5 | 35 | 60 |
| | 10 | 50 | 85 |
| Control 2 | 3 | 25 | 70 |
| | 5 | 40 | 80 |
| | 10 | 0 | 25 |
| Example IV | 3 | trace | 75 |
| | 5 | trace | 75 |
| | 10 | 0 | 15 |
| Example V | 3 | 0 | 65 |
| | 5 | 0 | 40 |
| | 10 | 0 | 10 |
| Example VI | 3 | trace | 80 |
| | 5 | 0 | 80 |
| | 10 | 0 | 80 |

Panels coated with the compositions of the present invention also are tested in a second humidity test identified as ASTM D-1748. This humidity cabinet test is designed to measure the ability of preservative coating to protect the metal parts from rusting under conditions of high humidity. The test apparatus consists of a cabinet designed with a rotating circular stage for holding test panels, and humidity control is provided by diffusing air through approximately 25 gallons of heated water at the bottom of the cabinet. Three panels are coated with each of the test blends by dipping, and after allowing the panels to drain, they are placed on the rotating stage and exposed to 100% relative humidity at 120° F. (49° C.) vapor temperature. The panels are observed to determine the number of hours to fail. A panel is considered to fail when one or more dots of rust appear larger than 1 mm. in diameter or the panel contains 4 or more dots of any size. The results obtained in this test are summarized in the following Table IV.

TABLE IV

| Humidity Test ASTM D-1748 | | |
|---|---|---|
| Composition | Concentration (% Wt.) | Hours to Fail (Average of 3) |
| Control 1 | 3 | 440 |
| | 5 | 916 |
| Control 2 | 3 | 288 |
| | 5 | 704 |
| Example IV | 3 | 656 |
| | 5 | 1248 |
| Example V | 3 | 912 |
| | 5 | 1200 |
| Example VI | 3 | 680 |
| | 5 | 1096 |

Preservative oils containing the corrosion-inhibiting compositions of the present invention exhibit good anti-staining properties on ferrous metal as measured by one-month stain test at 70° C. In this test, 10% by weight of water is dispersed in the preservative oil formulation, and three 2-inch by 4-inch panels are dipped in the formulation. The panels are clamped together and stored for one month at 70° C. After this time, the panels are separated and observed for staining. As mentioned above, panels coated with the composition of the present invention have good anti-stain properties. For example, a steel panel coated with the composition of Example V at a concentration of 5% by weight in oil contains only light edge stain after one month in the stain test.

While the invention has been described herein with respect to its preferred embodiments and illustrated by the presentation of specific examples, it is to be understood that various modifications thereof will be apparent to those skilled in the art upon reading the specification. It is intended that such modifications are within the scope of the invention which is limited only by the appended claims.

We claim:

1. A corrosion-inhibiting composition comprising a mixture of (A) at least one oil-soluble neutral or basic alkali metal or alkaline earth metal salt or complex of at least one organic acid, and (B) at least one nitrogen- and boron-containing composition which is the reaction product of at least one amino alcohol, at least one of a boric acid or boron trioxide, and at least one organic carboxylic acid; with the proviso that said corrosion-inhibiting composition is free of microcrystalline wax.

2. The composition of claim 1 wherein (B) is prepared by (i) reacting at least one amino alcohol with at least one organic carboxylic acid to form an intermediate, and (ii) reacting said intermediate with at least one of a boric acid or boron trioxide.

3. The composition of claim 1 wherein (A) is at least one oil-soluble basic alkaline earth metal salt or complex of a phenol, sulfonic acid, carboxylic acid or phosphorus acid.

4. The composition of claim 1 wherein (A) is at least one oil-soluble basic alkaline earth metal salt or complex of an organic sulfonic acid.

5. The composition of claim 1 wherein the organic carboxylic acid is at least one monocarboxylic acid containing from about 8 to about 22 carbon atoms, dimers or trimers of said acids or mixtures thereof.

6. The composition of claim 1 wherein the nitrogen- and boron-containing composition (B) is prepared by (i) heating a mixture of at least two molar proportions of a secondary or tertiary aliphatic amino alcohol with one molar proportion of at least one of a boric acid or boron trioxide to an elevated temperature while removing the water of reaction to yield an intermediate, (ii) reacting said intermediate with at least one organic carboxylic acid and removing the water formed in the reaction.

7. The composition of claim 1 wherein (A) comprises a mixture of calcium and barium salts of at least one oil-soluble organic sulfonic acid.

8. The composition of claim 1 wherein the weight ratio of (A):(B) is from about 5:1 to about 1:5.

9. The composition of claim 1 wherein (B) is prepared by (i) reacting an excess of at least one amino alcohol with at least one of a boric acid or boron trioxide to form an intermediate, and (ii) reacting said intermediate with at least one organic carboxylic acid.

10. The composition of claim 9 wherein at least two molar equivalents of an amino alcohol are reacted with a boric acid in step (i).

11. The composition of claim 1 wherein the amino alcohol is a secondary or tertiary aliphatic amino alcohol.

12. The composition of claim 11 wherein the amino alcohol is a secondary aliphatic amino alcohol.

13. A corrosion-inhibiting composition comprising a mixture of (A) at least one neutral or basic alkaline earth metal salt of at least one oil-soluble organic sulfonic acid, (B) at least one nitrogen- and boron-containing composition which is the reaction product of at least one of a boric acid or tertiary aliphatic amino alcohol, at least one of a boric acid or boron trioxide, and at least one organic carboxylic acid, and (C) at least one inert normally liquid organic diluent; with the proviso that said corrosion-inhibiting composition is free of microcrystalline wax.

14. The composition of claim 13 wherein the composition is a concentrate, and the weight ratio of (A):(B):(C) is within the range of (10–50):(5–40):(10–85).

15. The composition of claim 13 comprising from about 0.2 to about 30 weight percent of (A), about 0.1 to about 15 weight percent of (B) and from about 55 to about 99.7 weight percent of (C).

16. The composition of claim 13 wherein (A) comprises a mixture of basic calcium and barium salts of the same or different organic sulfonic acids.

17. The composition of claim 16 wherein the organic sulfonic acids are petroleum sulfonic acids.

18. The composition of claim 13 wherein the nitrogen- and boron-containing composition (B) is prepared by (i) reacting at least two molar equivalents of at least one secondary or tertiary aliphatic amino alcohol with a boric acid to form an intermediate, and (ii) reacting said intermediate with at least one organic carboxylic acid containing from about 8 to about 22 carbon atoms, dimers or trimers of said acid, or mixtures thereof.

19. The composition of claim 18 wherein the aliphatic amino alcohol is a secondary aliphatic amino alcohol.

20. The composition of claim 19 wherein the organic carboxylic acid contains from about 12 to about 22 carbon atoms.

21. The composition of claim 13 wherein the nitrogen- and boron-containing composition (B) is prepared by (i) reacting an excess of at least one secondary or tertiary aliphatic amino alcohol with at least one organic carboxylic acid to form an intermediate, (ii) reacting said intermediate with a boric acid.

22. The composition of claim 21 wherein the aliphatic amino alcohol is a secondary aliphatic amino alcohol and the organic carboxylic acid contains from about 12 to about 22 carbon atoms.

23. A corrosion-inhibiting composition comprising a mixture of (A-1) at least one neutral or basic calcium salt of at least one oil-soluble organic sulfonic acid, (A-2) at least one neutral or basic barium salt of at least one oil-soluble organic sulfonic acid, (B) at least one nitrogen- and boron-containing composition which is a reaction product of at least one secondary or tertiary aliphatic amino alcohol, a boric acid, and at least one organic carboxylic acid, and (C) a normally liquid inert organic diluent; with the proviso that said corrosion-inhibiting composition is free of microcrystalline wax.

24. The composition of claim 23 wherein the sulfonic acid of the salts (A-1) and (A-2) are each independently petroleum sulfonic acid or synthetic sulfonic acids.

25. The composition of claim 23 wherein the salts (A-1) and (A-2) are basic non-carbonated salts.

26. The composition of claim 23 wherein the nitrogen- and boron-containing composition (B) is prepared by reacting (i) at least two molar equivalents of at least one secondary amino alcohol with boric acid, and removing the water formed in the reaction to form an intermediate, and (ii) reacting said intermediate with at least one organic carboxylic acid containing from 12 to 22 carbon atoms and removing the water formed in the reaction.

27. The composition of claim 23 wherein the inert diluent is a lubricating oil.

28. The composition of claim 23 wherein the composition is a concentrate comprising from about 5 to 25 parts by weight of (A-1), about 5 to about 25 parts parts by weight of (A-2), about 5 to about 40 parts by weight (B), and about 10 to about 85 parts by weight of the inert diluent (C).

29. The composition of claim 23 comprising about 0.1 to about 15% by weight of (A-1), about 0.1 to about 15% by weight of (A-2), about 0.1 to 15% by weight of (B), and about 55 to 99.70% by weight of (C).

* * * * *